US006675752B1

(12) United States Patent
Kunne et al.

(10) Patent No.: US 6,675,752 B1
(45) Date of Patent: Jan. 13, 2004

(54) INTERNAL COMBUSTION ENGINE WITH HYDRAULIC CAMSHAFT ADJUSTER FOR ADJUSTING THE CAMSHAFT

(75) Inventors: Ernst-Andreas Kunne, Schwülper (DE); Andreas Knecht, Kusterdingen (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 10/088,453

(22) PCT Filed: Sep. 12, 2000

(86) PCT No.: PCT/EP00/08904

§ 371 (c)(1),
(2), (4) Date: Mar. 13, 2002

(87) PCT Pub. No.: WO01/20135

PCT Pub. Date: Mar. 22, 2001

(30) Foreign Application Priority Data

Sep. 13, 1999 (DE) ..... 199 43 833

(51) Int. Cl.[7] ..... F01L 1/34

(52) U.S. Cl. ..... 123/90.17; 123/90.15; 123/90.16; 123/90.27; 464/160

(58) Field of Search ..... 123/90.15, 90.16, 123/90.17, 90.18, 90.27, 90.31, 90.34; 464/1, 2, 160

(56) References Cited

U.S. PATENT DOCUMENTS 5,150,671 A * 9/1992 Suga ..... 123/90.17
5,540,197 A 7/1996 Golovatai-Schmidt et al. .. 123/90.17
5,794,579 A * 8/1998 Moriya ..... 123/90.17
5,803,031 A * 9/1998 Moriya ..... 123/90.17
5,954,019 A * 9/1999 Yoshikawa et al. ..... 123/90.17
6,026,772 A * 2/2000 Shirabe ..... 123/90.17
6,032,629 A * 3/2000 Uchida ..... 123/90.34
6,129,063 A * 10/2000 Niethammer et al. .... 123/90.17
6,244,230 B1 * 6/2001 Mikame ..... 123/90.17

FOREIGN PATENT DOCUMENTS

| | | |
|---|---|---|
| DE | 42 29 202 A1 | 3/1994 |
| DE | 195 25 836 | 8/1996 |
| DE | 195 25 837 A1 | 1/1997 |
| DE | 196 11 606 A1 | 9/1997 |
| DE | 197 26 365 | 12/1998 |
| EP | 798 449 A1 | 10/1997 |
| EP | 863 297 A1 | 9/1998 |

* cited by examiner

*Primary Examiner*—Thomas Denion
*Assistant Examiner*—Ching Chang
(74) *Attorney, Agent, or Firm*—Ostrolenk, Faber, Gerb & Soffen, LLP

(57) ABSTRACT

An internal combustion engine including a cylinder head having gas-exchange valves, at least one camshaft supported on the cylinder head, which camshaft is driven by a crankshaft to actuate corresponding gas-exchange vales on the cylinder head, and a camshaft adjuster arranged on the camshaft. The adjuster has a hydraulic pressure chamber and is configured to use hydraulic pressure to rotate position of the camshaft relative to the crankshaft to change control times of the gas-exchange valves. A feed device for hydraulic pressure is provided on the camshaft adjuster and is configured as a component separate from the cylinder head. The feed device has a ring for each camshaft, each ring having two grooves, each of the grooves being connected via associated hydraulic pressure channels in the feed device to a hydraulic pressure valve. Each ring is arranged to surround a section of the camshaft. Each surrounded section of the camshaft has two ring-shaped grooves, each of which is aligned with one of the grooves of the corresponding ring to form a pair. Each groove/ring-shaped groove pair of a ring is connected via associated hydraulic pressure channels in the camshaft to the hydraulic pressure chamber of the camshaft adjuster mounted on the camshaft.

5 Claims, 16 Drawing Sheets

INTERNAL COMBUSTION ENGINE WITH HYDRAULIC CAMSHAFT ADJUSTER FOR ADJUSTING THE CAMSHAFT

PRIORITY CLAIM

This is a U.S. national stage of application No. PCT/EP00/08904, filed on Sep. 12, 2000. Priority is claimed on that application and on the following application: Country: Germany, Application No. 199 43 833.1, filed Sep. 13, 1999.

BACKGROUND OF THE INVENTION

The invention pertains to an internal combustion engine with a cylinder head and at least one camshaft supported thereon, which shaft, driven by a crankshaft, actuates corresponding gas-exchange valves on the cylinder head. A camshaft adjuster, which uses hydraulic pressure to rotate the position of the camshaft relative to the crankshaft and thus to change the control times of the gas-exchange valves, is provided on the camshaft. A feed device for supplying hydraulic pressure to the camshaft adjuster is also provided. The invention also pertains to a feed device for supplying hydraulic medium to the camshaft adjuster of a camshaft of an internal combustion engine. The invention also pertains to a process for producing a feed device as indicated above.

A device for changing the control times of the gas-exchange valves of an internal combustion engine is known from DE 197-45,670 A1, where a camshaft adjuster is mounted on one end of a camshaft, which actuates the gas-exchange valves. By means of pressure medium channels provided in a housing cover, the camshaft adjuster is supplied with hydraulic pressure for rotating the position of the camshaft relative to a crankshaft, which drives the camshaft. The housing cover, however, is complicated and expensive to produce and install.

It is known from DE 197-47,244 A1 that ring-shaped grooves can be provided in the cylinder head at one end of a camshaft in the area where the camshaft is supported and that hydraulic medium can be supplied via these ring-shaped grooves to a camshaft adjuster mounted on the camshaft. To prevent losses in the area of the bearing of the camshaft when the hydraulic medium is tapped, a plain bearing ring is laid in a half liner of the bearing, this ring covering the half liner. This integration of the hydraulic medium supply system into the cylinder head itself makes it difficult and expensive to produce the cylinder head. In addition, because the hydraulic medium is supplied by way of the bearing liner of the bearing of the camshaft in the cylinder head, the bearing is weakened to a corresponding extent.

SUMMARY OF THE INVENTION

The present invention, therefore, is based on the task of making available an internal combustion engine, a feed device, and a process of the above-indicated type, where the disadvantages described above are overcome, so that an improved and functionally reliable camshaft adjusting function is available.

In an internal combustion engine of the type indicated above, it is provided in accordance with the invention that the feed device for hydraulic pressure is designed as a component separate from the cylinder head and that this device has a ring for each camshaft, each ring surrounding a certain section of the camshaft. Each ring has two grooves, and the associated surrounded section of the camshaft has two ring-shaped grooves, which are aligned with the grooves of the corresponding ring. Each groove/ring-shaped groove pair of a ring is connected via its own set of hydraulic pressure channels in the camshaft to a hydraulic pressure chamber of the camshaft adjuster mounted on this camshaft. Furthermore, each groove/ring-shaped pair of a ring is connected by its own set of hydraulic pressure channels in the feed device to a hydraulic pressure valve.

This has the advantage of making available a system for feeding hydraulic medium to camshaft adjusters which is both simple to produce and simple to install.

In a preferred embodiment, the feed device for hydraulic pressure in the separate component comprises the following integral parts: at least one hydraulic pressure connection, at least one hydraulic tank connection, at least one socket for a hydraulic pressure valve, and corresponding hydraulic pressure channels, which are designed in such a way that they connect each hydraulic pressure connection to a socket which holds a hydraulic pressure valve, each hydraulic pressure valve to a groove/ring-shaped groove pair of a ring, and each socket for a hydraulic pressure valve to a hydraulic tank connection. The socket which holds the hydraulic pressure valve can be, for example, either parallel or perpendicular to the axis of the ring.

Designing the hydraulic pressure valve as a 4/2-port proportional distributing valve makes it possible to provide the camshaft with the capacity to rotate to any desired intermediate position between the two end positions of the camshaft and also to provide it at the same time with a wide rotational range extending over more than, for example, 60°.

It is advisable to design the feed device in such a way that it can be attached to the cylinder head.

In a feed device of the type indicated above, it is provided according to the invention that this feed device is designed as a component separate from the cylinder head and attachable to it, and that the device has a ring for each camshaft, each ring surrounding a certain section of the camshaft. Each ring has two grooves, which are connected to hydraulic pressure channels in the feed device to a hydraulic pressure valve.

This offers the advantage that, with the use of ring-shaped grooves appropriately provided in the surrounded section of the camshaft and hydraulic pressure channels, a system for supplying hydraulic medium to the camshaft adjuster is provided which is simple both to produce and to install.

In a preferred embodiment, the separate component has the following elements as integral parts: at least one hydraulic pressure connection, at least one hydraulic tank connection, at least one socket for a hydraulic pressure valve, and corresponding hydraulic pressure channels, which are designed in such a way that they connect each hydraulic pressure connection to a socket which holds a hydraulic pressure valve, each hydraulic pressure valve to a groove/ring-shaped groove pair of a ring, and each socket for a hydraulic pressure valve to a hydraulic tank connection. The socket which holds the hydraulic pressure valve can be, for example, either parallel or perpendicular to the axis of the ring.

Designing the hydraulic pressure valve as a 4/2-port proportional distributing valve makes it possible to provide the camshaft with the capacity to rotate to any desired intermediate position between the two end positions of the camshaft and also to provide it at the same time with a wide rotational range extending over, for example, more than 60°.

To produce the feed device mentioned above, the separate component is, for example, cast as a single piece with the ring or rings and with the socket or sockets for hydraulic pressure valve or valves, and then the hydraulic pressure connection and the hydraulic pressure channels are formed in the separate component by drilling blind holes and through-holes. The ends of the blind holes and through-holes forming the various hydraulic pressure channels which are open toward the outside are then sealed off. The open ends of the through-holes are advisably sealed off by pressing in close-fitting balls, and each hydraulic pressure connection is provided with a nonreturn valve. So that a good seal is provided between the separate component and the cylinder head on which it is mounted, appropriate flange surfaces are produced on the separate component afterwards by grinding, for example, in the areas where the component will rest on the cylinder head.

BRIEF DESCRIPTION OF THE DRAWINGS

Additional features, advantages, and advantageous embodiments of the invention can be derived from the dependent claims as well as from the following description of the invention on the basis of the attached drawings:

DETAILED DESCRIPTION OF THE PREFERRED EMBODIMENTS

Figure 1:
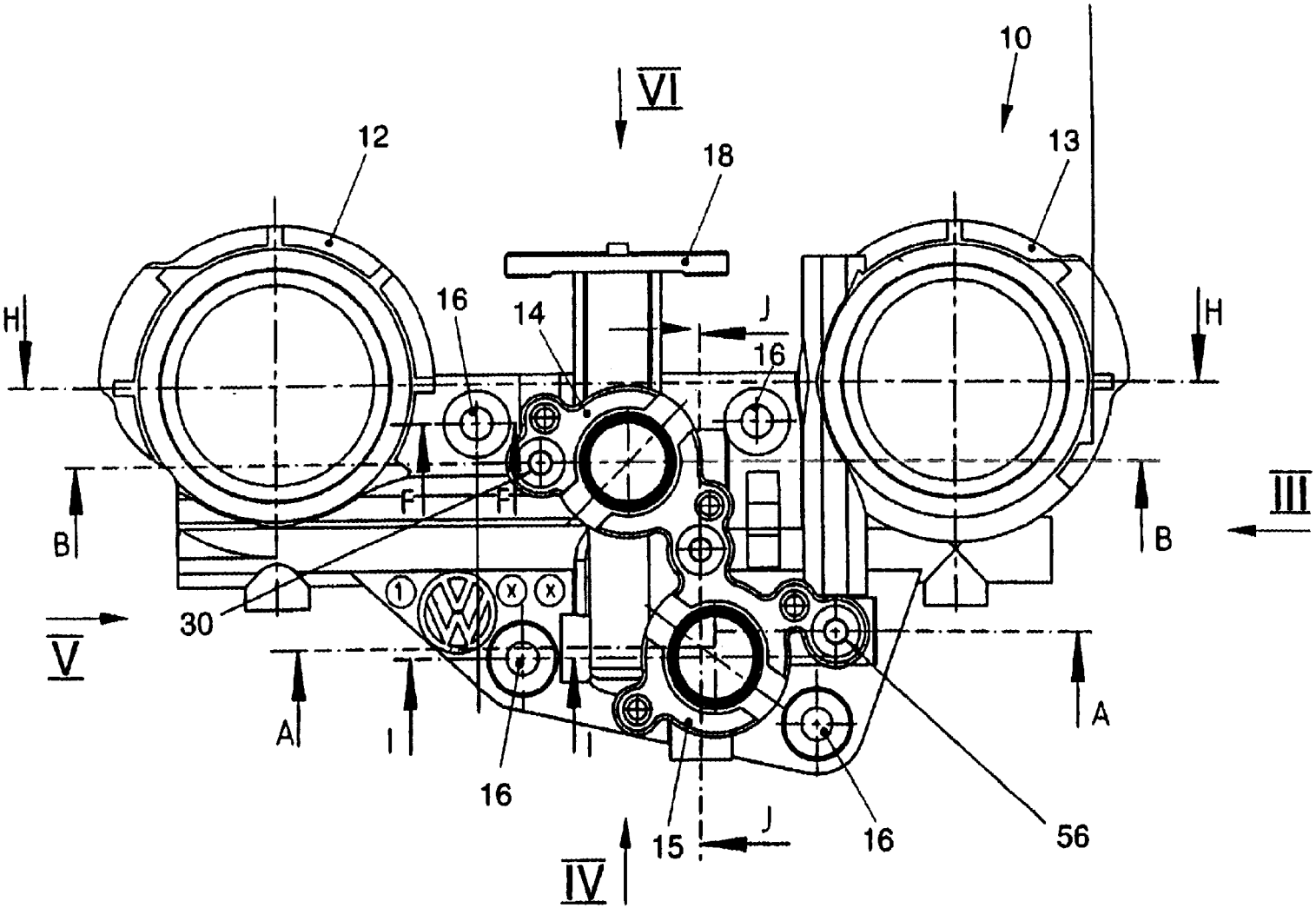
FIG. 1 is a front view of a preferred embodiment of a feed device according to the invention.

So that the relationships of the individual views according to FIGS. 3–8 and 13 to each other can be understood more clearly, broken lines identified with an "x" are drawn in each of these figures for reference. The preferred embodiment of a feed device according to the invention for supplying hydraulic medium illustrated in FIGS. 1–13 on a camshaft adjuster (not shown) is designed as a separate component 10 with two rings 12, 13 and sockets 14, 15 for hydraulic pressure valves (not shown). The rings 12, 13 surrounded predetermined sections of the associated camshafts (not shown) and serve as transfer points for hydraulic medium to the camshaft and to the camshaft adjuster connected to the camshaft, as will be explained in greater detail below.

The separate component can be attached to the cylinder head (not shown) by means of screws (not shown), which pass through the holes 16. The surfaces shown shaded or hatched in FIG. 2 form the corresponding surfaces which come into contact with the cylinder head. A bracket 18 for a slide rail (not shown) for a chain or belt drive (not shown), mounted between a crankshaft (not shown) and the camshafts surrounded by the rings 12, 13, is attached to the component 10.

Figure 15:
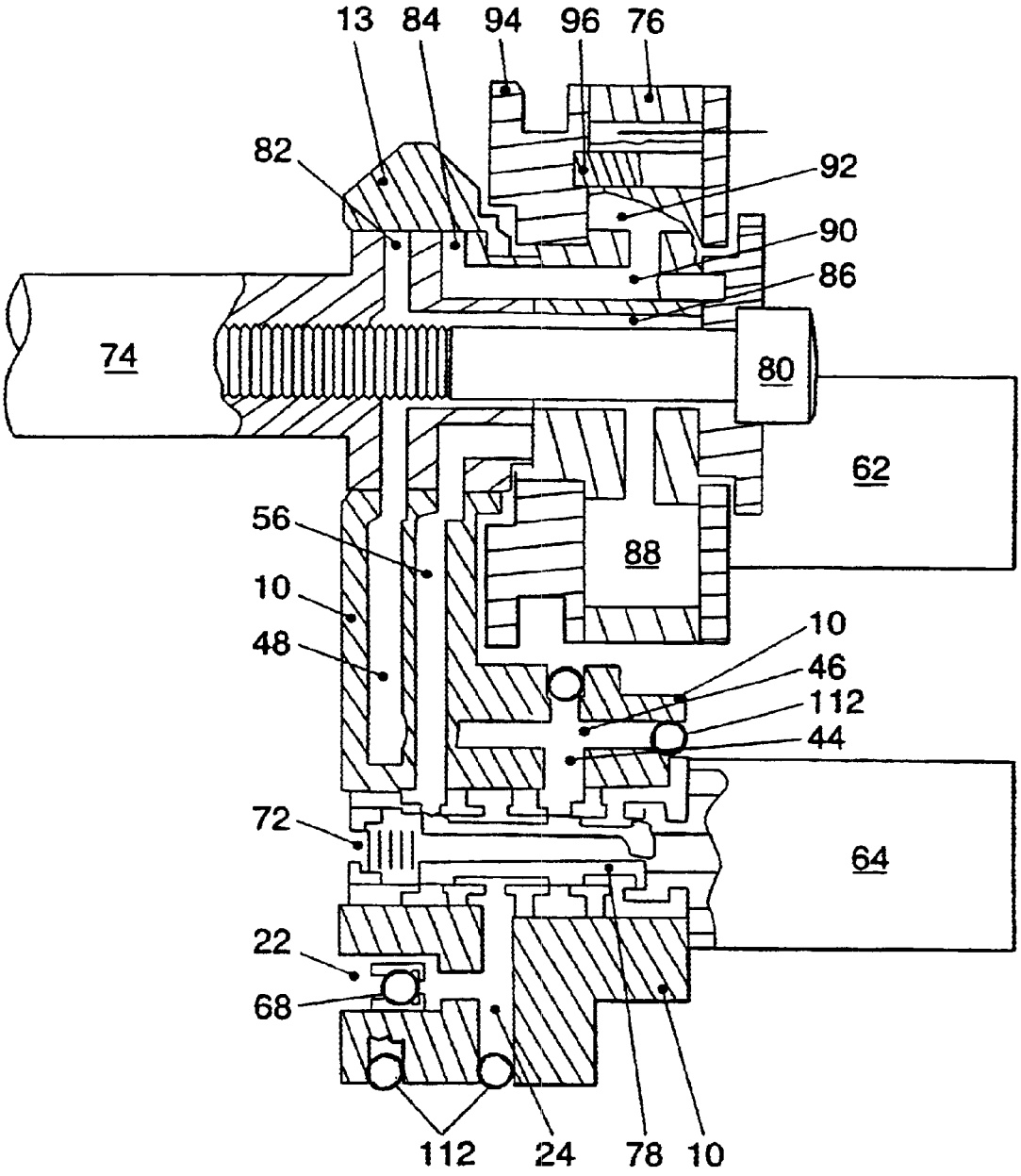
FIG. 15 is a schematic side view of a mounted feed device during operation.

According to the invention, the component 10 has a system of hydraulic pressure channels, which is explained in the following. After the component 16 has been produced by means of, for example, casting, this system of hydraulic pressure channels is formed in the component 10 by the introduction of corresponding blind holes and through-holes. An opening to the outside is thus necessarily produced for each blind hole and through-hole. To the extent that these openings are not required for the operation of the component 10, they are sealed off in a pressure-tight manner by pressing balls or bolts into them. Balls 112 are shown in FIG. 15 by way of example.

Figure 2:
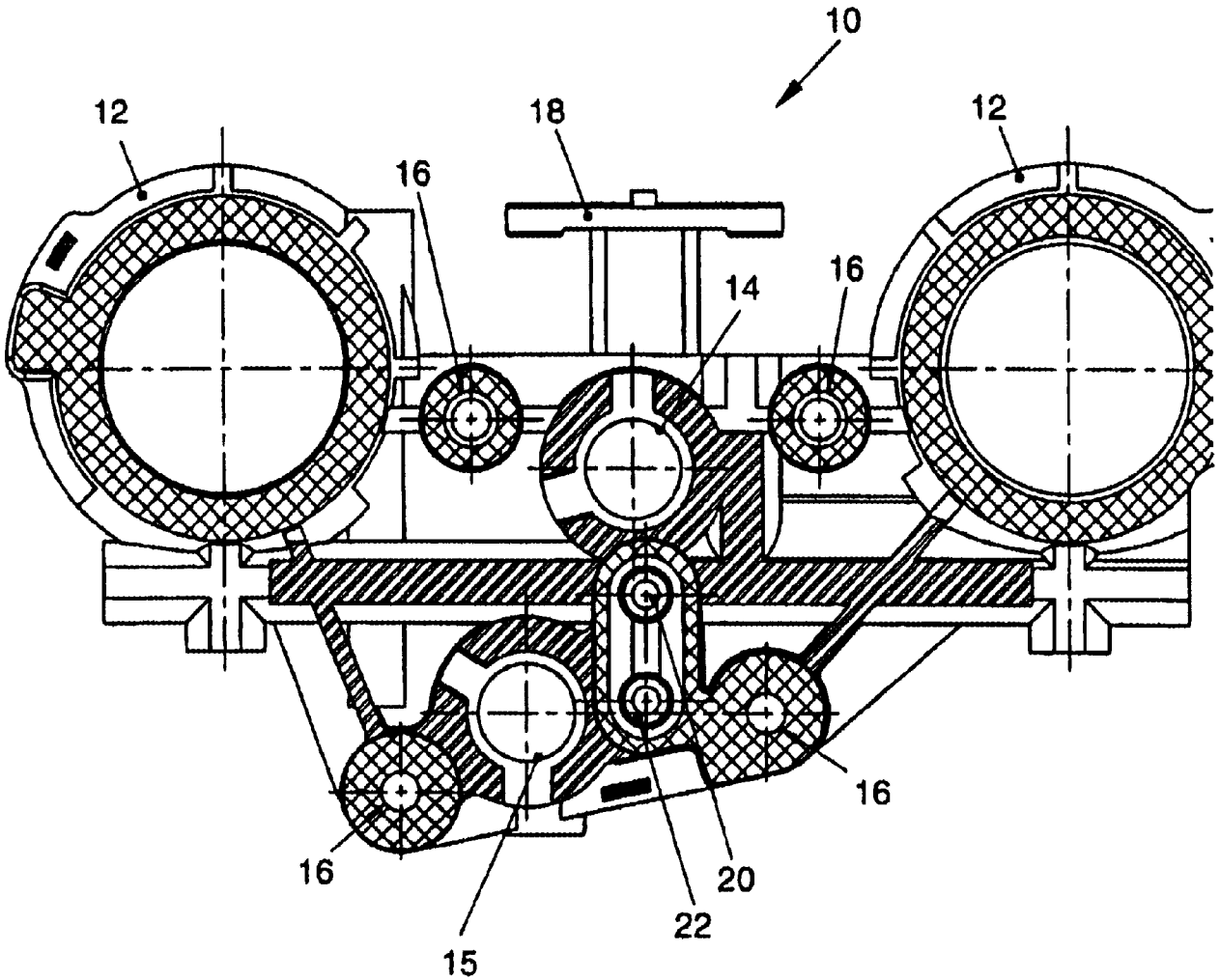
FIG. 2 is a rear view.
Figure 3:
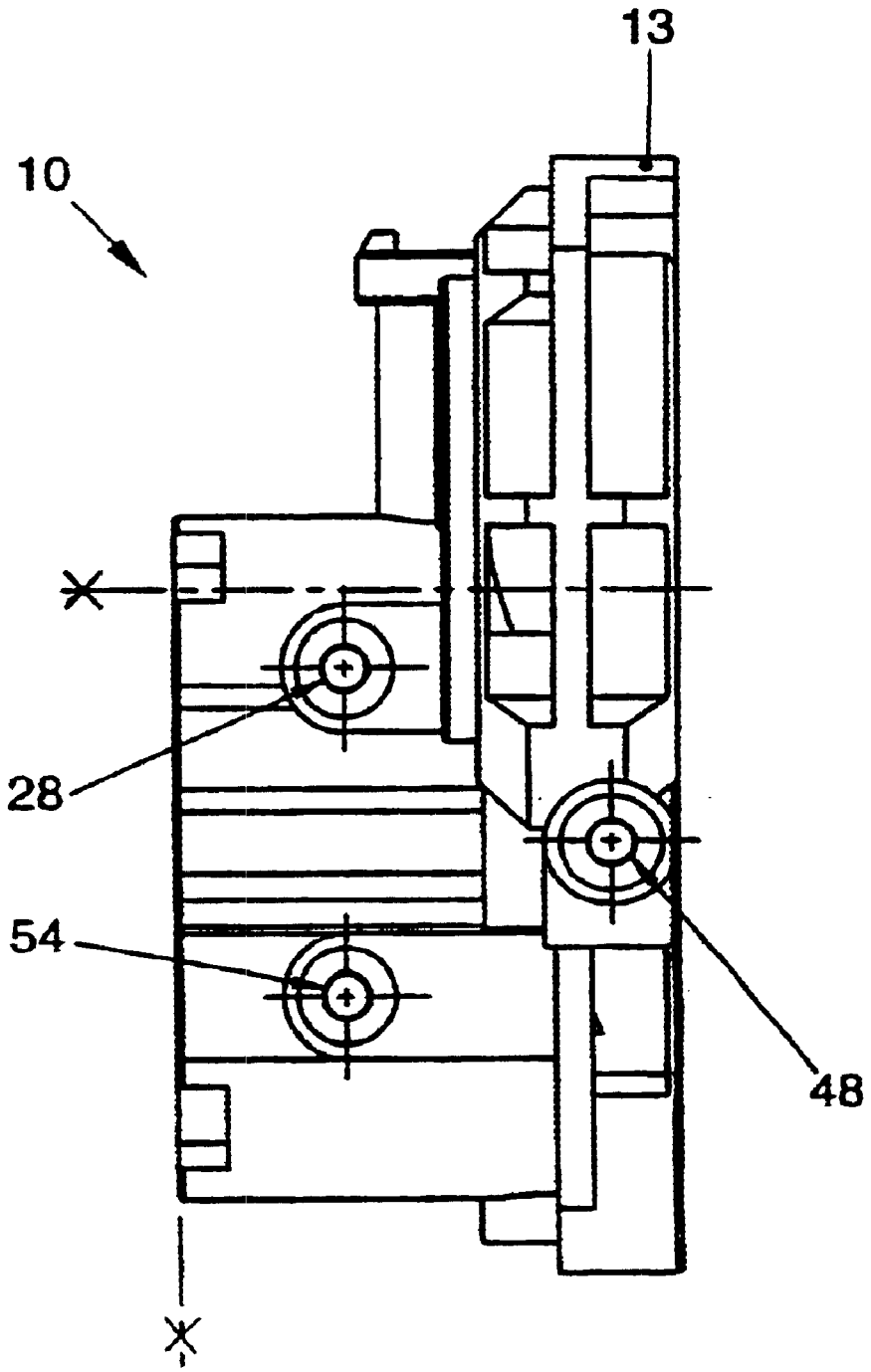
FIG. 3 is a side view in the direction of arrow III of FIG. 1.
Figure 4:
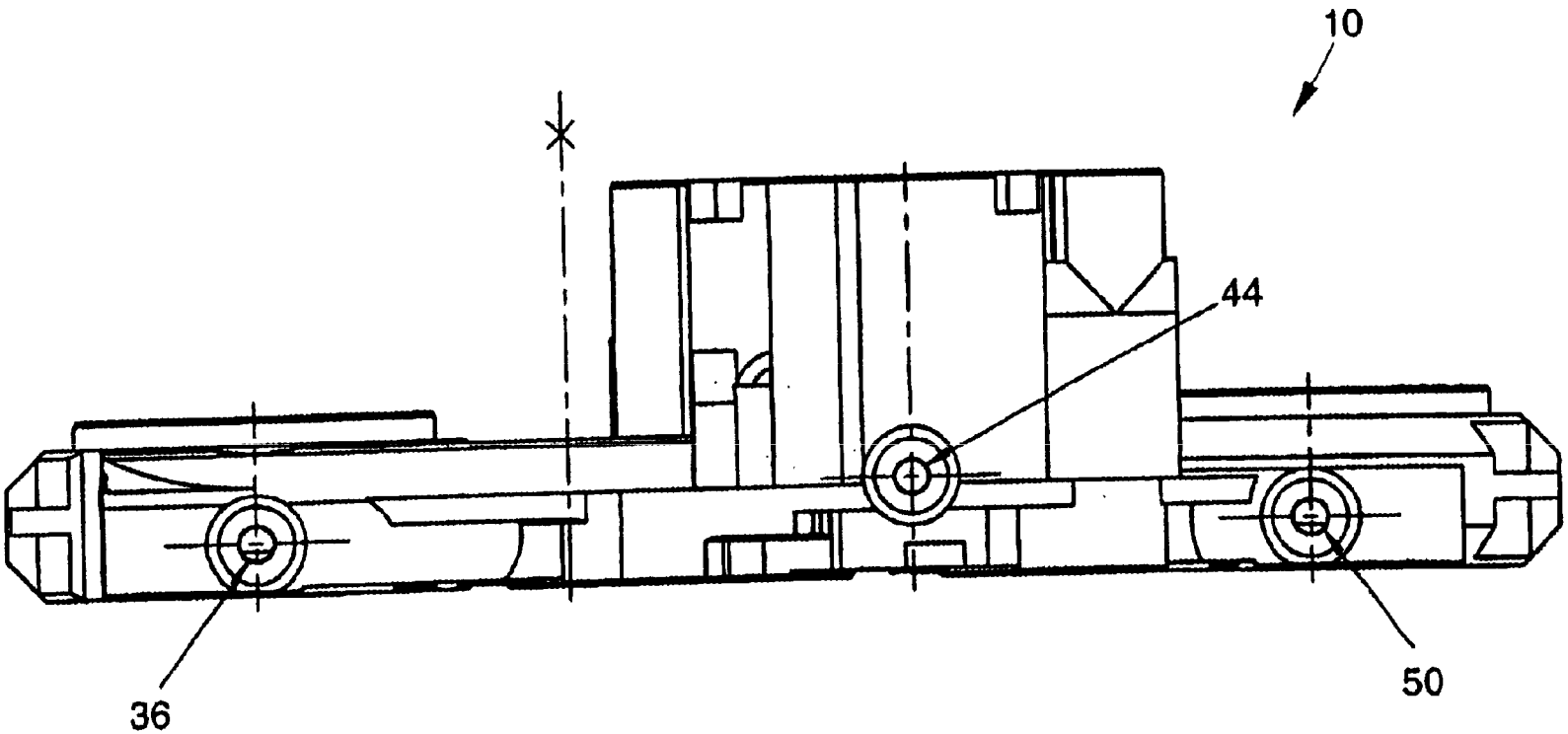
FIG. 4 is a view from underneath in the direction of arrow IV of FIG. 1.
Figure 5:
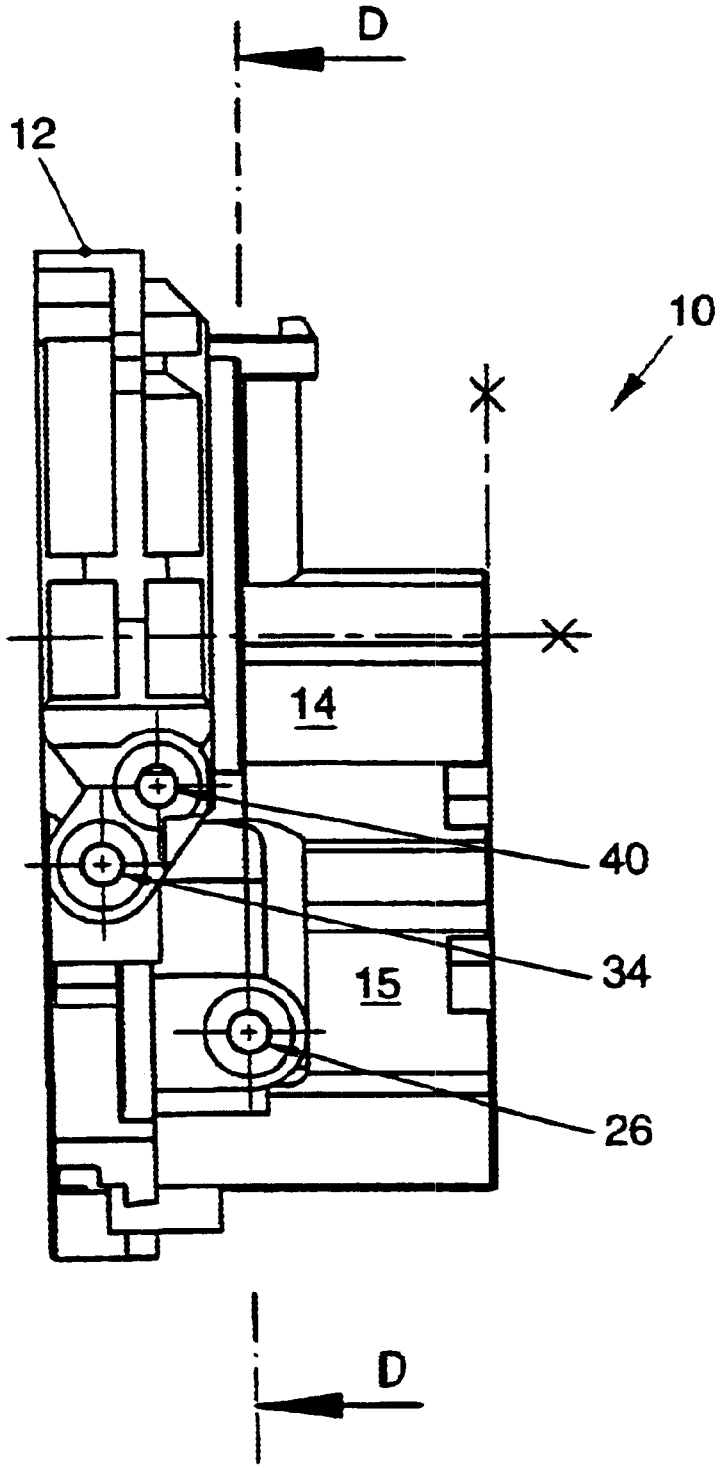
FIG. 5 is a side view in the direction of arrow V of FIG. 1.
Figure 6:
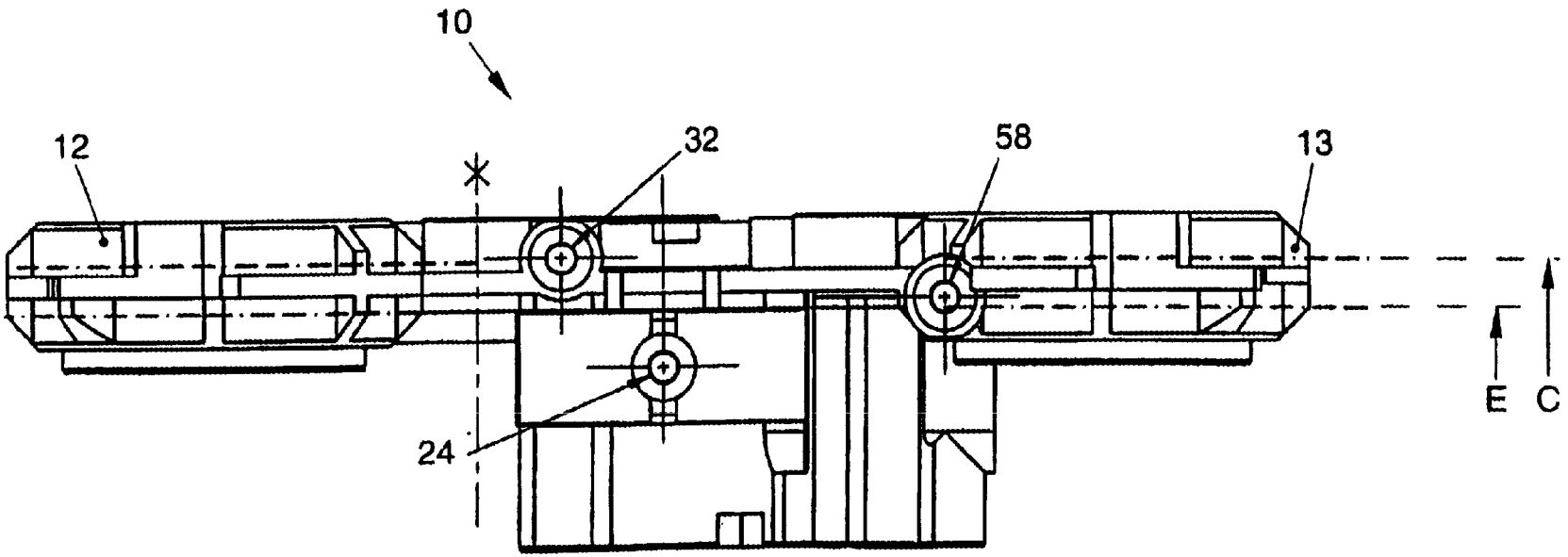
FIG. 6 is a view from above in the direction of arrow VI of FIG. 1.
Figure 7:
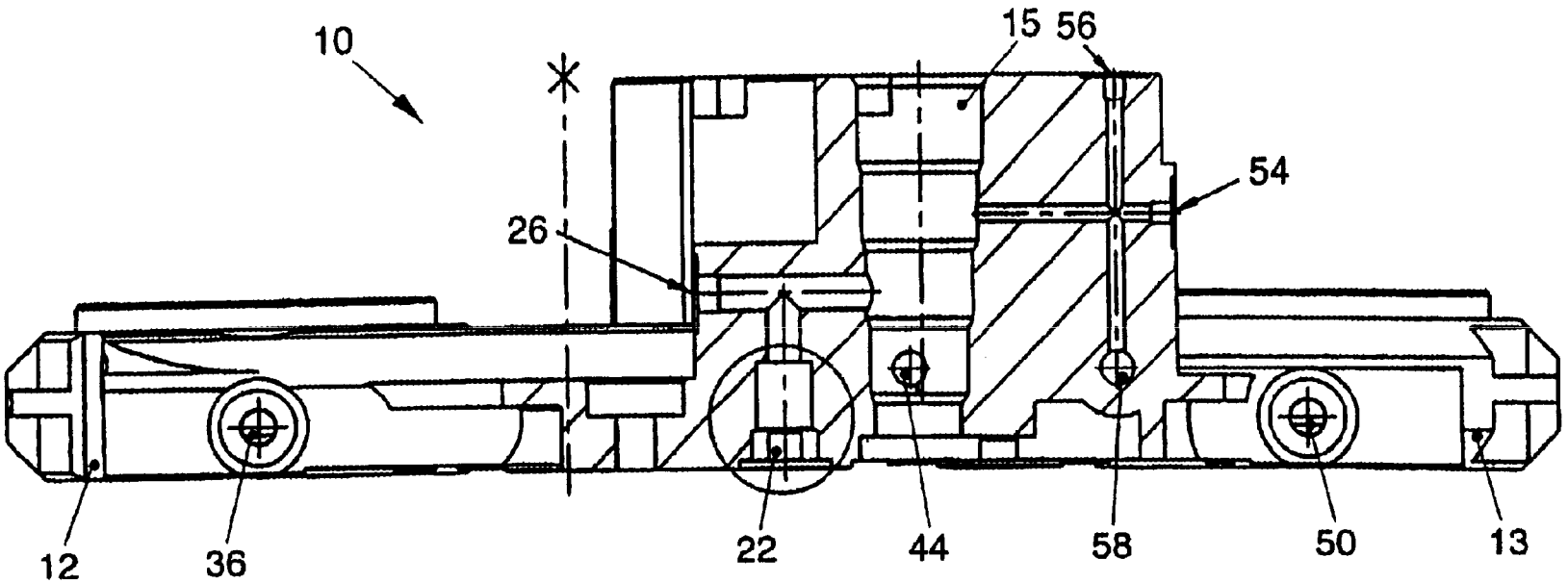
FIG. 7 is a sectional view along line A—A of FIG. 1.
Figure 10:
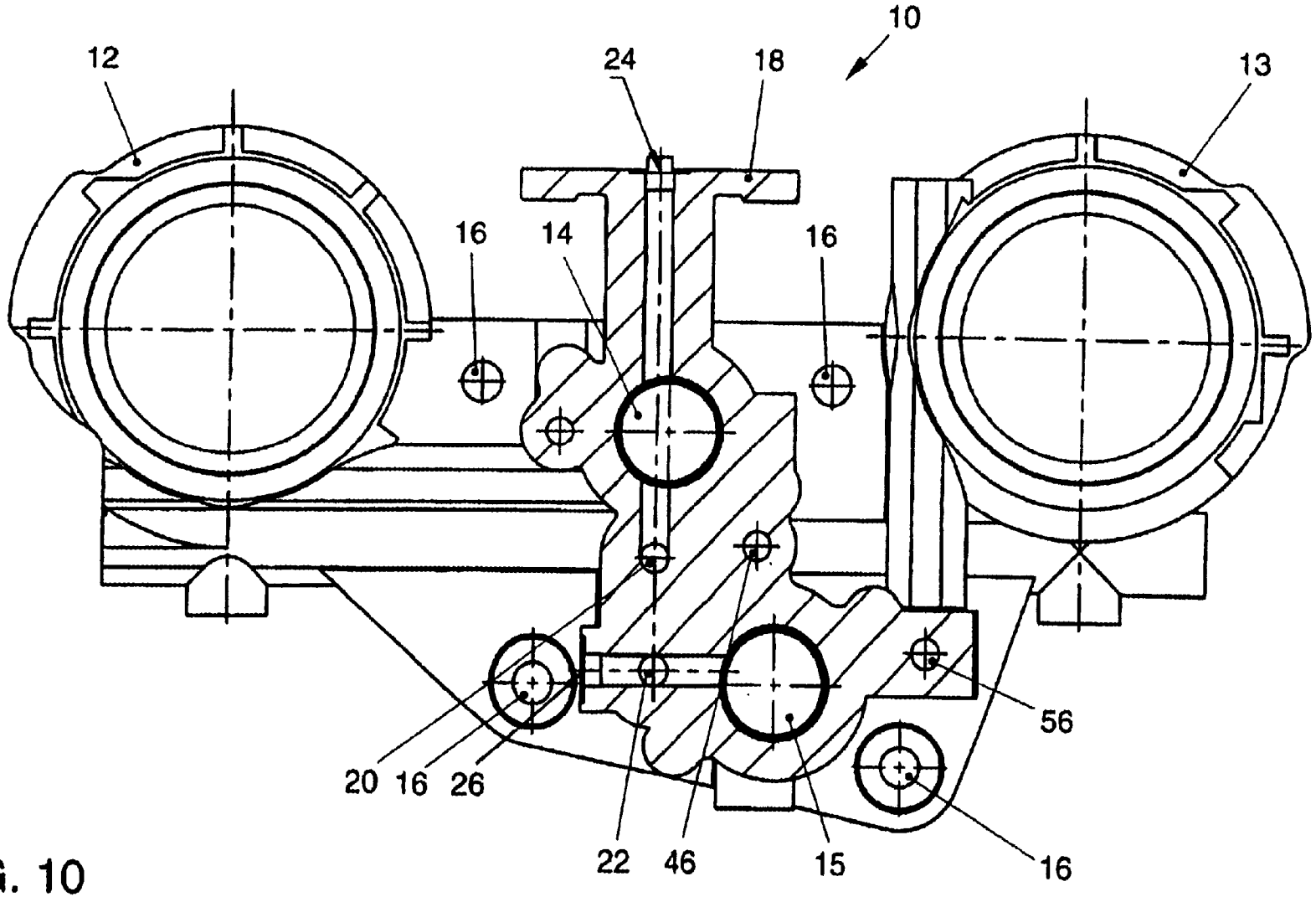
FIG. 10 is a sectional view along line D—D of FIG. 5.

As can be seen especially clearly in FIG. 2, the component 10 has two separate hydraulic pressure connections 20, 22 on the rear side, i.e., on the side facing the cylinder head, which connections receive hydraulic pressure from the cylinder head. The first hydraulic pressure connection 20, as can be seen especially in FIG. 10, is connected by a first hydraulic pressure channel 24 to the first socket 14, and the second hydraulic pressure connection 22, as can be seen especially in FIGS. 7 and 10, is connected to a second hydraulic pressure channel 26 to the second socket 15. The first hydraulic pressure channel 24, starting from the bracket 18, passes through the first socket 14 and arrives at the first hydraulic pressure connection 20 and is sealed off pressure-tight at the bracket end. The second hydraulic channel 26 extends laterally (from the left in FIGS. 7 and 10) through the second hydraulic pressure connection 22 and arrives at the second socket 15 and is also sealed off pressure-tight at the external hole.

Figure 8:
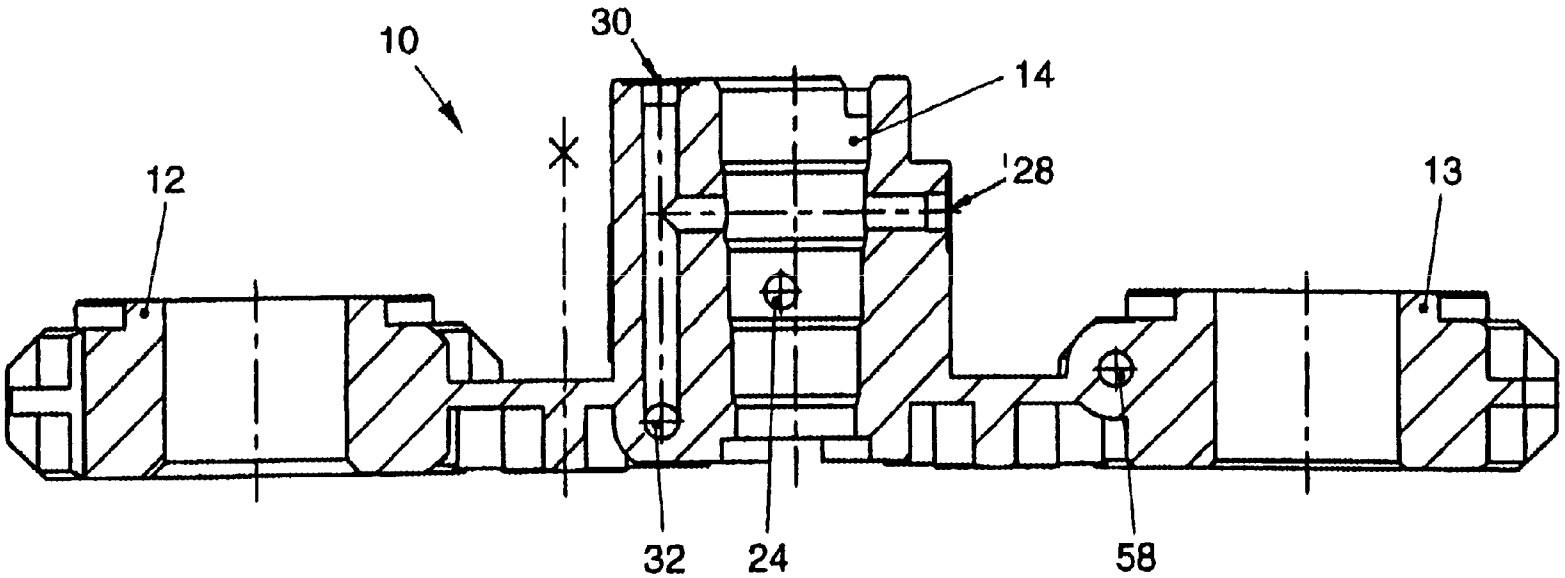
FIG. 8 is a sectional view along line B—B of FIG. 1.
Figure 9:
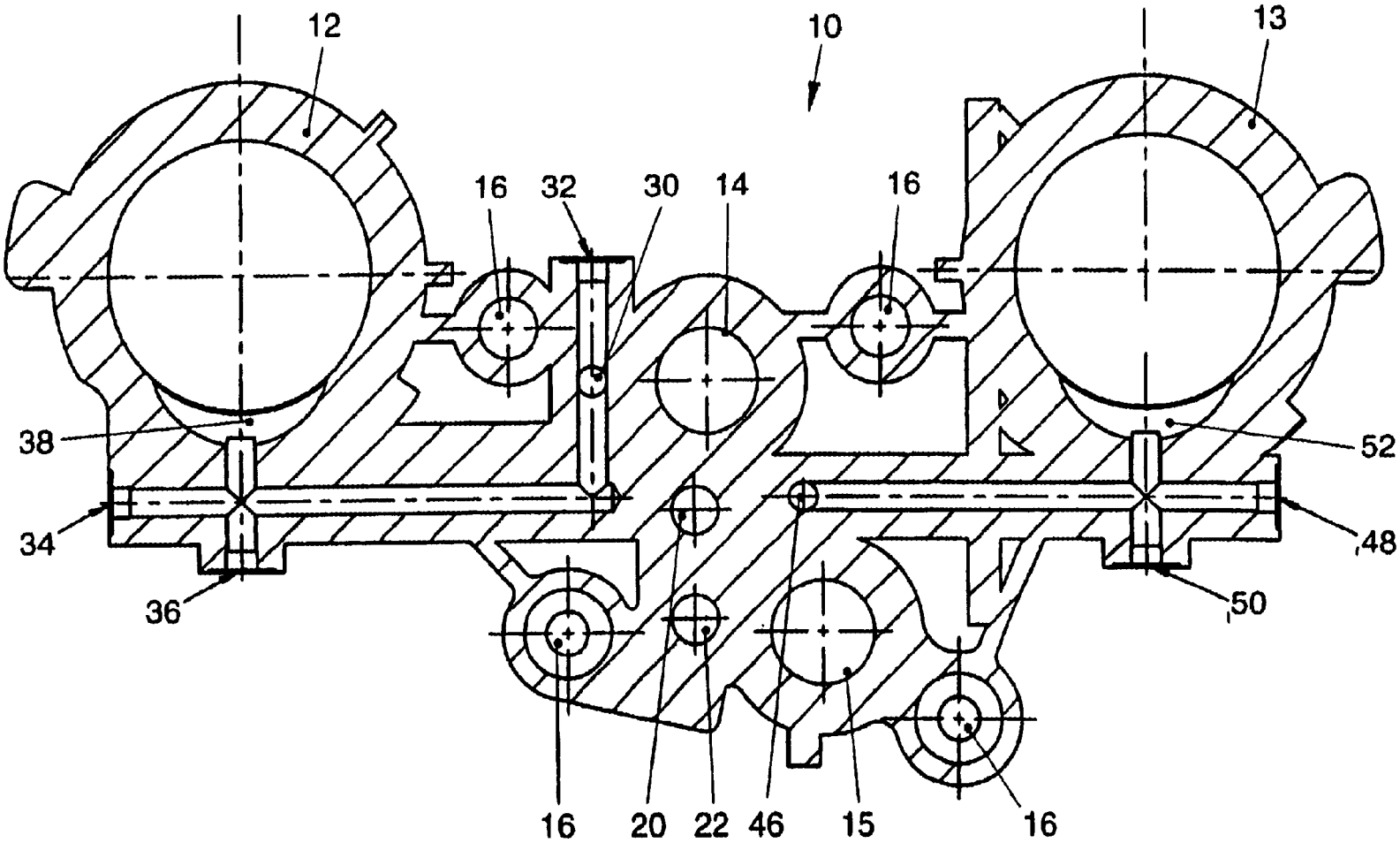
FIG. 9 is a sectional view along line C—C of FIG. 6.
Figure 11:
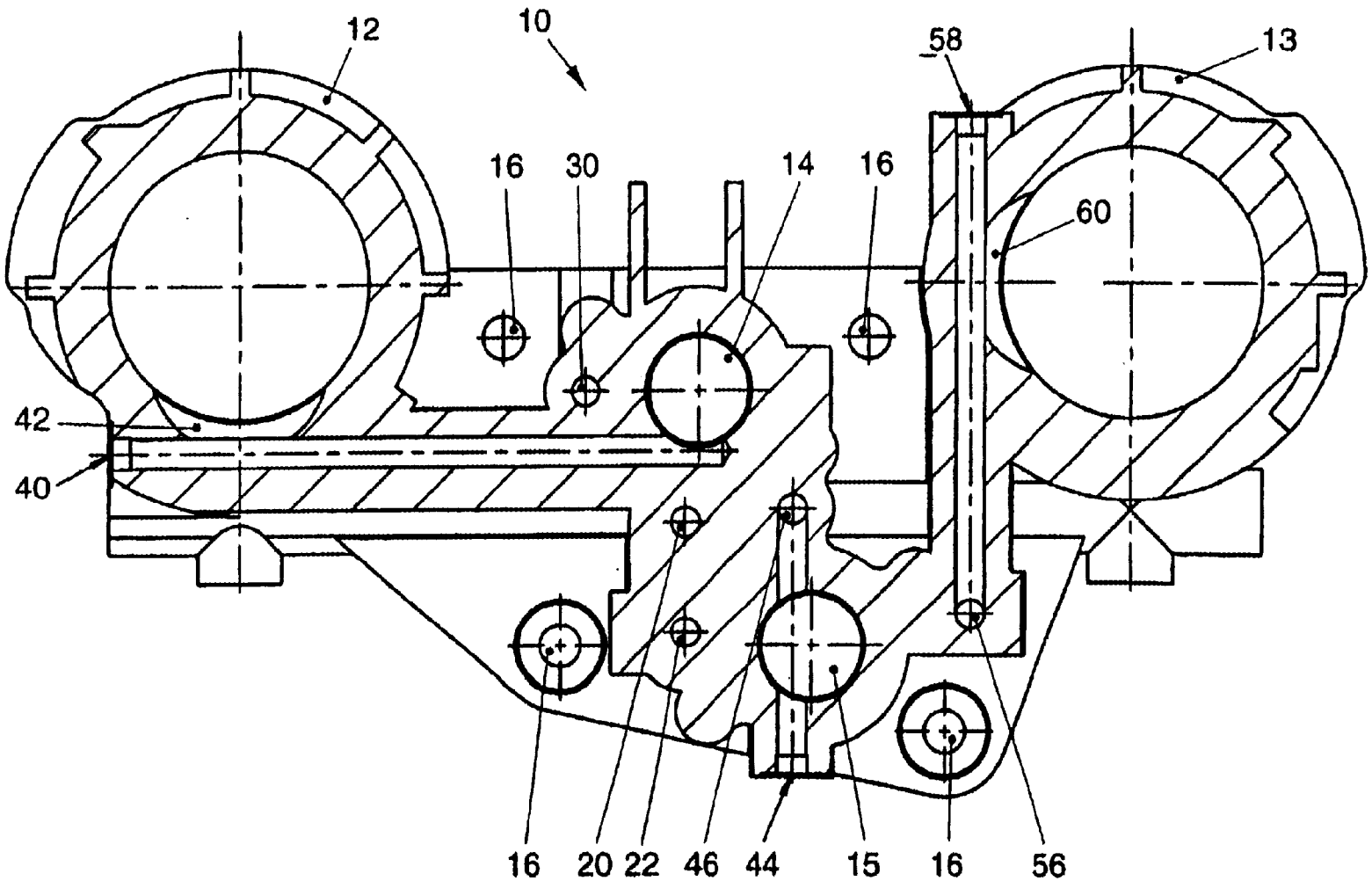
FIG. 11 is a sectional view along line E—E of FIG. 6.
Figure 12:
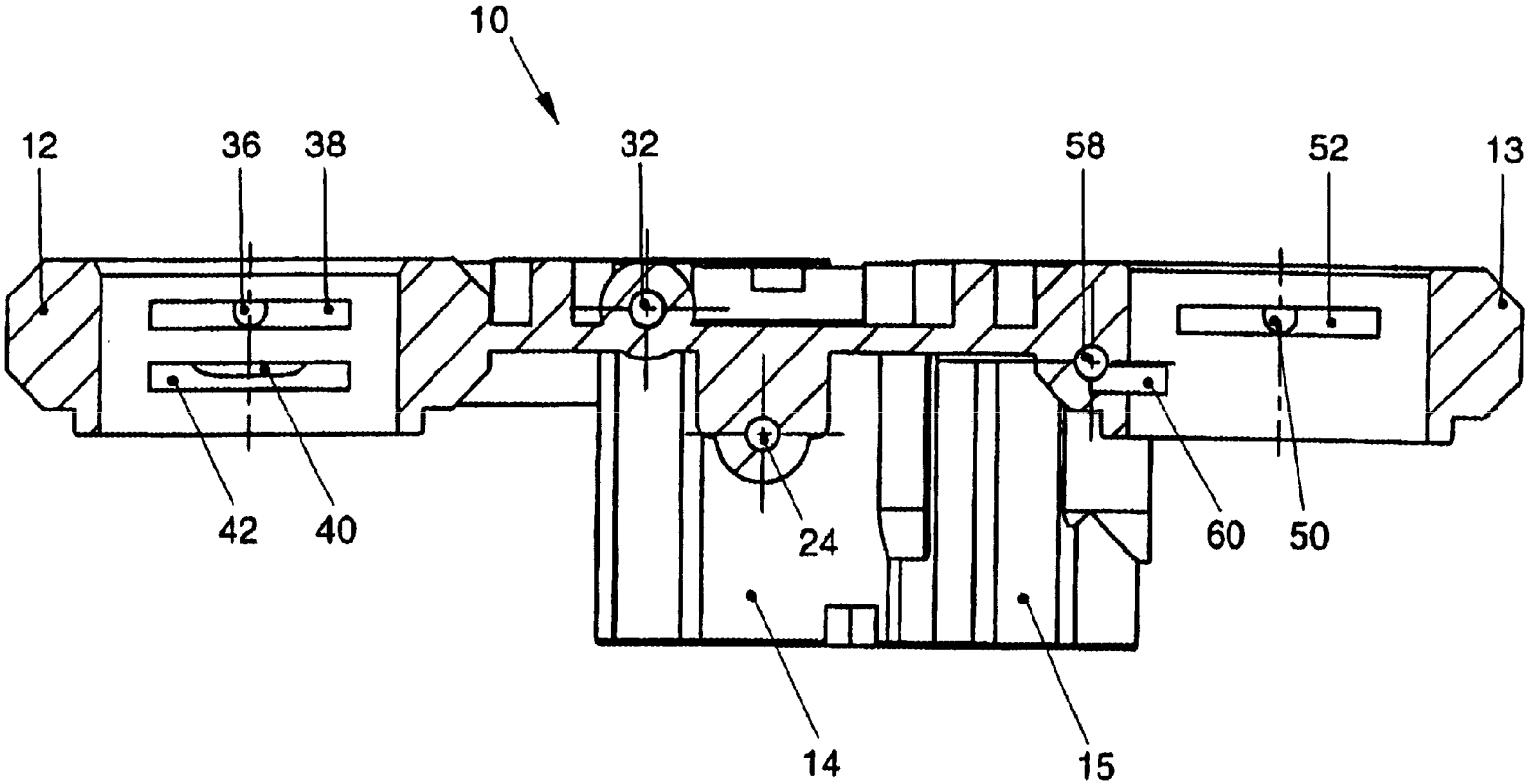
FIG. 12 is a sectional view along line H—H of FIG. 1.
Figure 13:
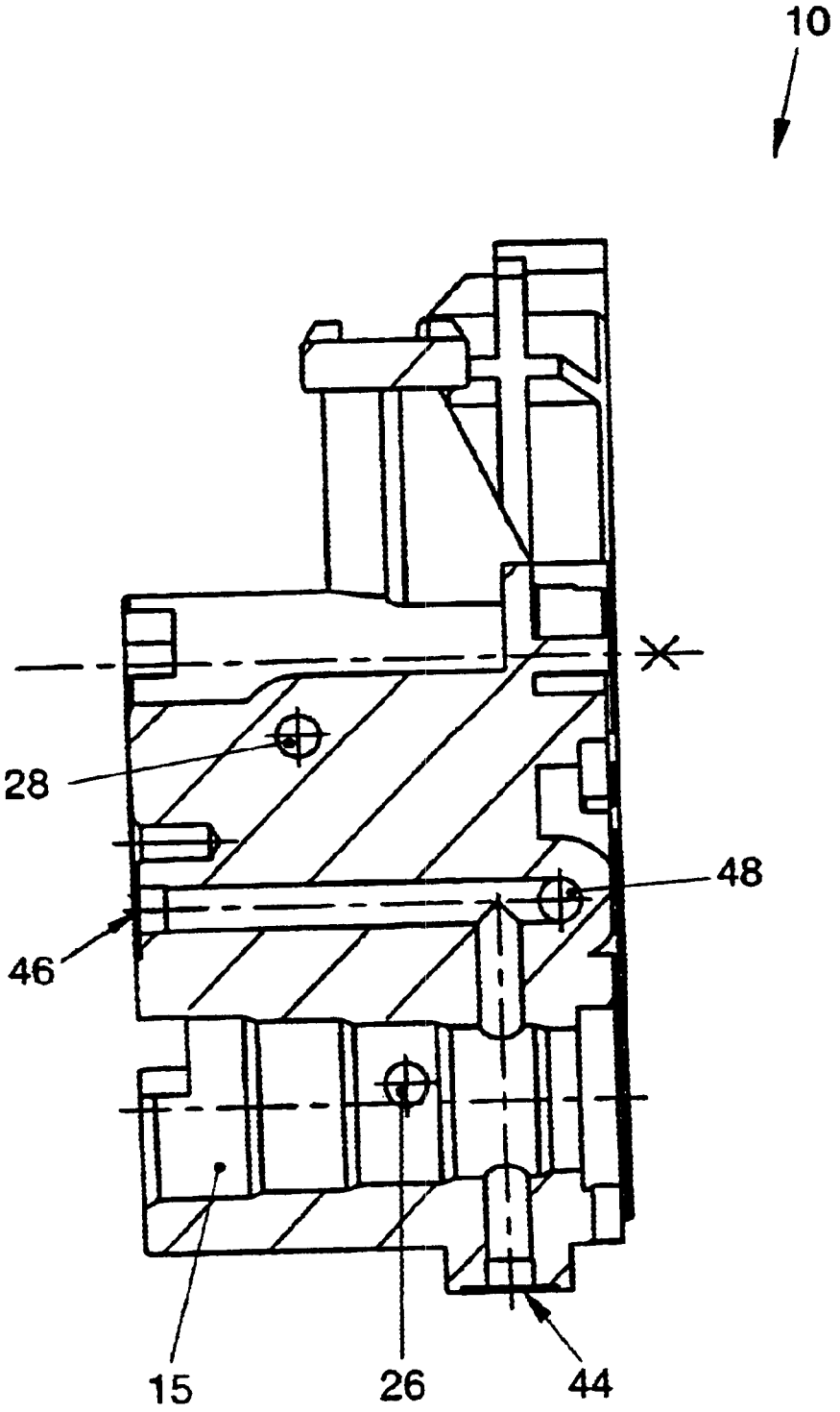
FIG. 13 is a sectional view along line J—J of FIG. 1.

The first socket 14, as can be seen especially clearly in FIGS. 8, 9, and 12, is connected by a third hydraulic pressure channel 28, a fourth hydraulic pressure channel 30, a fifth hydraulic pressure channel 32, a sixth hydraulic pressure channel 34, and a seventh hydraulic pressure channel 36 to a first groove 38 in the first ring 12. The first socket, furthermore, as can also be seen in FIGS. 11 and 12, is connected by an eighth hydraulic pressure channel 40 to a second groove 42 of the first ring 12.

The second socket 15, as can be seen especially in FIGS. 9, 11, 12, and 13, is connected by a ninth hydraulic pressure channel 44, a tenth hydraulic pressure channel 46, an eleventh hydraulic pressure channel 48, and a twelfth hydraulic pressure channel 50 to a first groove 52 of the second ring 13. The second socket 15, furthermore, as can be seen especially in FIGS. 7, 11, and 12, is connected by a thirteenth hydraulic pressure channel 54, a fourteenth hydraulic pressure channel 56, and a fifteenth hydraulic pressure channel 58 to a second groove 60 of the second ring 13.

In the sections surrounded by the rings 12 and 13, the camshaft (not shown in FIGS. 1–13) has corresponding ring-shaped grooves, which are aligned with the grooves 38, 42 of the first ring 12 and with the grooves 52, 60 of the second ring 13, respectively. These ring-shaped grooves are connected in turn to hydraulic pressure channels in the camshaft, which are connected to corresponding hydraulic pressure chambers of a camshaft adjuster mounted on this camshaft. The application of hydraulic pressure via the first grooves 38, 52 of the rings 12, 13 and via the above-mentioned hydraulic pressure channels causes the corresponding camshaft to rotate its position with respect to the crankshaft in one direction, and the application of hydraulic pressure via the second grooves 42, 60 of the rings 12, 13 and the above-mentioned hydraulic pressure channels causes the corresponding camshaft to rotate its position with respect to the crankshaft in the corresponding opposite direction. One direction loads to an "early" position; that is, the valves are actuated earlier or in advance of the movement of the crankshaft, and the corresponding other direction leads to a "late" position; that is, the valves are actuated later or trailing the movement of the crankshaft.

As a result of the 4/2-port proportional distributing valves provided in the sockets 14, 15, it is also possible to arrive at a stable intermediate position between these two extremes, i.e., between the extreme early and the extreme late position. It is advisable for the camshaft adjuster to be locked in the extreme late position, so that this position can be maintained without the need for pressure and also so that it will not be influenced by the forces acting on the camshaft as a result of valve actuation.

So that the positions of the camshafts turning in the rings 12, 13 can be rotated, the hydraulic pressure valves mounted in the sockets 14, 15, which are driven by a control unit (not shown), which will be explained below with reference to FIG. 16, apply pressure through corresponding hydraulic pressure channels proceeding away from the sockets 14, 15. If, for example, the position of the camshaft turning in the first ring 12 is to be rotated in a certain direction (e.g., to an early position), then the hydraulic pressure valve mounted in the socket 14 sends pressure through the hydraulic pressure channels 28, 30, 32, 34, and 36 (see FIGS. 8 and 9, in this sequence). This pressure is then conducted onwards via the first groove 38 in the first ring 12 to the camshaft and thus to a corresponding hydraulic pressure chamber of the camshaft adjuster. If the position of the camshaft turning in the first ring 12 is to be rotated in the other direction (e.g., to a late position), then the hydraulic pressure valve mounted in the socket 14 applies pressure to the hydraulic pressure channel 40 (see FIGS. 11 and 12), which pressure is then sent on via the second groove 42 in the first ring 12 to the camshaft and thus to the corresponding hydraulic pressure chamber of the camshaft adjuster. If an intermediate position between early and late is to be produced, the hydraulic pressure valve mounted in the socket 14 applies pressure to both the hydraulic pressure channels 28, 30, 32, 34, 36 and to the hydraulic pressure channel 40 and automatically regulates the two pressures in such a way that the desired positional rotation or adjustment of the camshaft results.

If the camshaft rotating in the second ring 13 is to be rotated in a certain direction (e.g., to an early position), the hydraulic pressure valve mounted in the socket 15 applies pressure to the hydraulic pressure channels 44, 46, 48, and 50 (compare FIGS. 13 and 9, in this sequence), and this pressure is then transmitted via the first groove 52 in the second ring 13 to the camshaft and thus to a corresponding hydraulic pressure chamber of the camshaft adjuster. If the position of the camshaft turning in the second ring 13 is to be rotated in the other direction (e.g., to a late position), the hydraulic pressure valve in socket 15 applies pressure to the hydraulic pressure channels 54, 56, 58 (see FIGS. 7 and 11, in this sequence), which is then transmitted via the second groove 60 in the second ring 13 to the camshaft and thus to the corresponding hydraulic pressure chamber of the camshaft adjuster. If an intermediate position between the early and late positions is to be produced, the hydraulic pressure valve in the socket 15 applies pressure both to the hydraulic pressure channels 44, 46, 48, and 50 and to the hydraulic pressure channels 54, 56, 58 and regulates the two pressures in such a way that the desired positional rotation or adjustment of the camshaft results.

Figure 14:
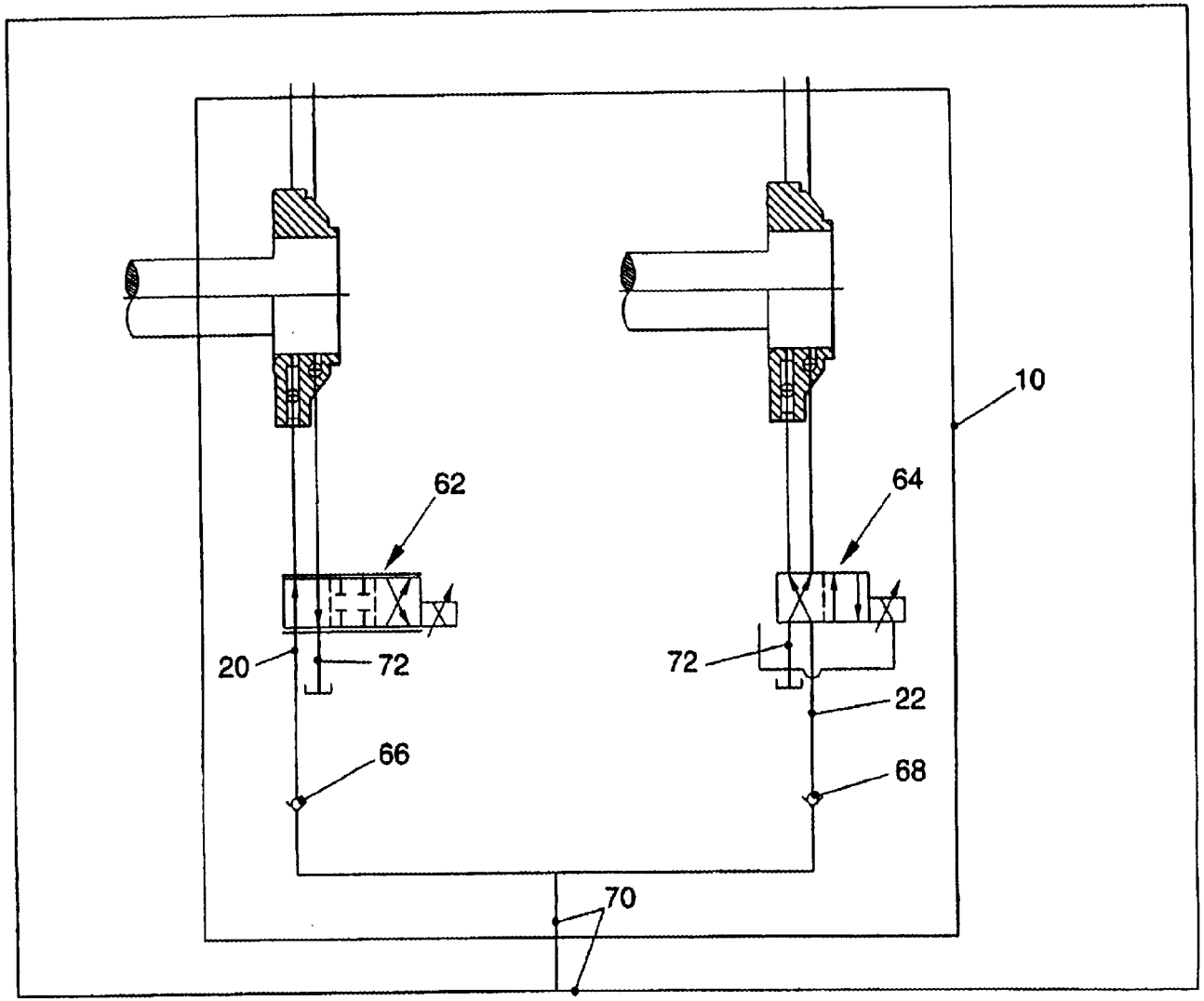
FIG. 14 is a schematic, functional block diagram of a hydraulic circuit of the feed device according to the invention.

FIG. 14 illustrates schematically the hydraulic pressure circuit provided in the separate component 10 according to the invention with the hydraulic pressure connections 20, 22 of the hydraulic pressure valves 62, 64, where each hydraulic pressure connection 20, 22 has a nonreturn valve 66, 68 and is connected to a hydraulic pump 70. The hydraulic pressure valves 62, 64 are designed either as 4/2-port S/W distributing valves or as 4/2-port proportional distributing valves. Each hydraulic pressure valve 62, 64 is also connected to a hydraulic tank connection 72.

FIG. 15 illustrates the function of the hydraulic pressure valves 62, 64 and the function of the combined effect of component 10, of the camshaft 74, and of the camshaft adjuster 76. This diagram of FIG. 15 is to understood only in schematic terms and does not show the exact spatial relationships of the hydraulic pressure valves 62, 64, as would be in FIGS. 1–13 after the hydraulic pressure valves have been inserted into the sockets 14, 15. The arrangement of the hydraulic pressure channels does not completely correspond to that according to FIGS. 1–13 either. The hydraulic pressure valve 64 is mounted in the socket 15 of the component 10; this valve has a piston 78. This piston 78, depending on its position, connects a hydraulic pressure feed across the socket 15 via the hydraulic pressure connection 22 and hydraulic pressure channel 24 either to the hydraulic pressure channels 44, 46, and 48 or to the hydraulic channel 56. In addition, the hydraulic pressure valve 64 has the hydraulic tank connection 72. The camshaft 74, which is connected by means of a screw 80 to the component 10 and to the camshaft adjuster 76, has two ring-shaped grooves 82, 84. Inside the ring 13, which extends completely around a section of the camshaft 74, the first ring-shaped groove 82 is in fluid-conducting connection with the hydraulic pressure channel 48, whereas the second ring-shaped groove 84 is connected to the hydraulic pressure channel 56. The grooves 52, 60 of the second ring 13 are not shown in FIG. 15. The first ring-shaped groove 82 is connected via a hydraulic pressure channel 86, which is formed in the camshaft 74 around the screw 80, to a first hydraulic pressure chamber 88 of the camshaft adjuster 76. The second ring-shaped groove 84 is connected via a hydraulic pressure channel 90 to a second hydraulic pressure chamber 92. Depending on which of the two hydraulic pressure chambers 88, 92 is put under pressure, the camshaft adjuster 76 turns the camshaft 74 relative to a wheel 94, which is connected via a drive (toothed-wheel or belt drive, not shown) to a crankshaft (not shown), in one or the other direction. In the diagram according to FIG. 15, the system is not under pressure, and the camshaft adjuster 76 is locked by means of a bolt 96 in the late position.

The position of the camshaft 74 is rotated into an early position relative to the crankshaft when the second hydraulic pressure chamber 92 is put under pressure via the hydraulic pressure channels 24, 56, 84, 90. The bolt 96 in this case is not engaged with the wheel 94. In contrast, the position of the camshaft 74 is rotated back to the late position when the first hydraulic pressure chamber 66 is put under pressure via the hydraulic pressure channels 24, 44, 46, 48, 82, and 86. The bolt 96 not latches with the wheel 94 again, and the pressure can be released from the system. To the extent that the second hydraulic pressure chamber 92 is put under pressure via the hydraulic pressure channels 24, 56, 84, and 90 and the first hydraulic pressure chamber 88 via the hydraulic pressure channels 24, 44, 46, 48, 82, and 86, the system is in the automatic control position, and an intermediate point between the extreme early and the extreme late position is automatically adjusted according to the value specified by the automatic control system.

Figure 16:
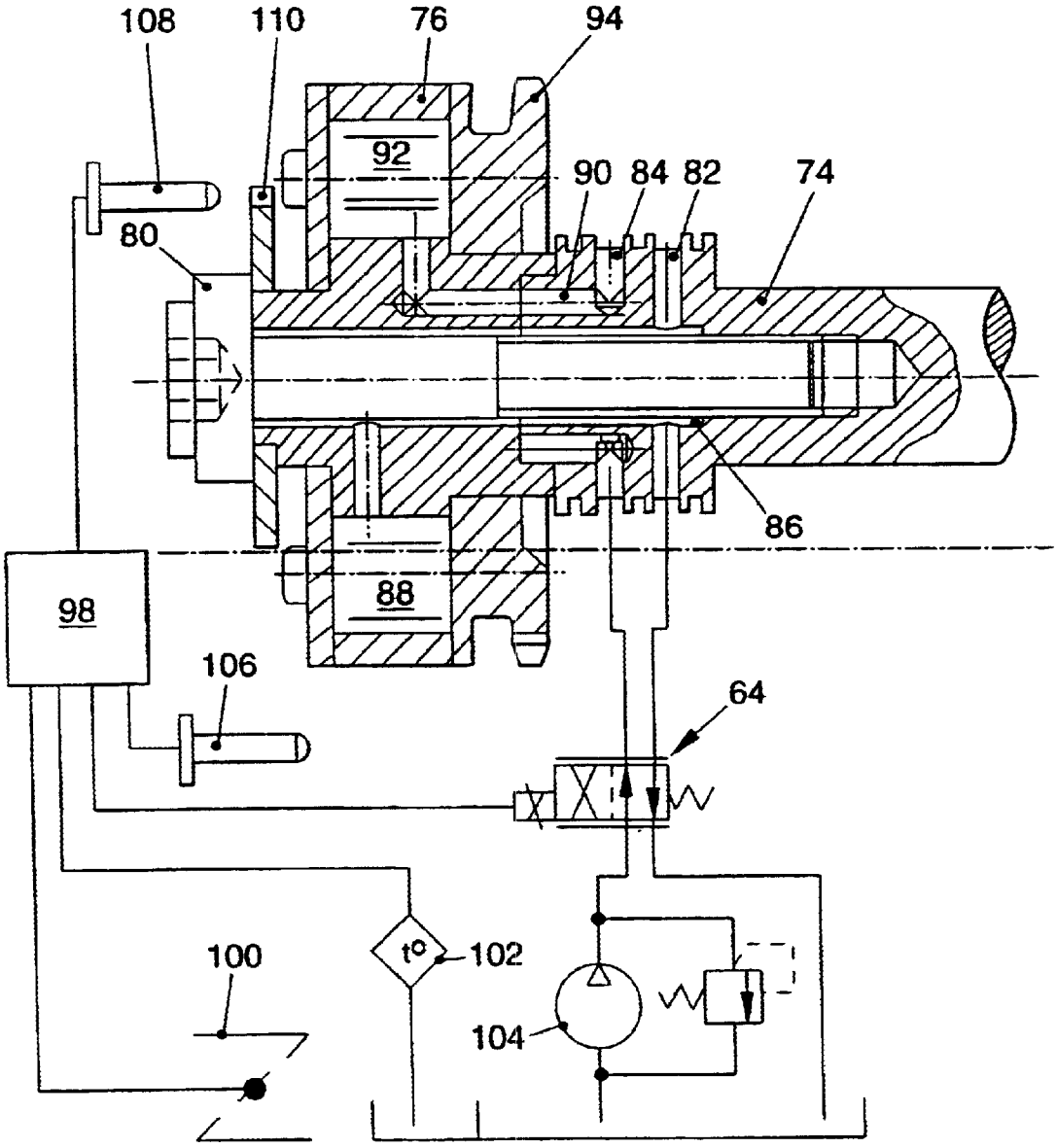
FIG. 16 is a schematic connection diagram of an automatic control system.

FIG. 16 illustrates schematically an automatic control system of this type. A CPU 98 (Central Processing Unit) receives data from a throttle valve 100; from an oil temperature sensor 102, which measures the temperature of the oil in the area of the engine oil pump 104; from a crankshaft sensor 106; and from a camshaft sensor 108, which cooperates with a signal transmitter 110 to determine the position of the camshaft 76. On the basis of these data, the CPU 98 actuates the hydraulic pressure valve 64 accordingly to produce the desired rotational angle of the camshaft 74 between the extreme early and the extreme later positions.

What is claimed is:

1. An internal combustion engine, comprising: a cylinder head having gas-exchange valves; at least one camshaft supported on the cylinder head, which camshaft is driven by a crankshaft to actuate corresponding gas-exchange valves on the cylinder head; a camshaft adjuster arranged on the camshaft, the adjuster having a hydraulic pressure chamber and being configured to use hydraulic pressure to rotate position of the camshaft relative to the crankshaft to change control times of the gas-exchange valves; and a feed device for providing hydraulic pressure to the camshaft adjuster and configured as a component separate from the cylinder head, the feed device having a ring for each camshaft, each ring having two grooves, each of the grooves being connected via associated hydraulic pressure channels in the feed device to a hydraulic pressure valve, each ring being arranged to surround a section of the camshaft, each surrounded section of the camshaft having two ring-shaped grooves, each of which grooves is aligned with one of the grooves of the corresponding ring to form a pair, each groove/ring-shaped groove pair of a ring is connected via associated hydraulic pressure channels in the camshaft to the hydraulic pressure chamber of the camshaft adjuster mounted on the camshaft.

2. An internal combustion engine according to claim 1, wherein the feed device for hydraulic pressure includes, as integral parts of the separate component, at least one hydraulic pressure connection, at least one hydraulic tank connection, at least one socket for a hydraulic pressure valve, and corresponding hydraulic pressure channels arranged so as to connect each hydraulic pressure connection to a socket for a hydraulic pressure valve, each hydraulic pressure valve to a groove/ring-shaped groove pair of a ring, and each socket for a hydraulic pressure valve to a hydraulic tank connection.

3. An internal combustion engine according to claim 2, wherein the socket for the hydraulic pressure valve is parallel to the axis of the ring.

4. An internal combustion engine according to claim 1, wherein the hydraulic pressure valve is a 4/2-port proportional distributing valve.

5. An internal combustion engine according to claim 1, wherein the feed device is configured so as to be attachable to the cylinder head.

* * * * *

UNITED STATES PATENT AND TRADEMARK OFFICE

CERTIFICATE OF CORRECTION

PATENT NO. : 6,675,752 B1
DATED : January 11, 2004
INVENTOR(S) : Kunne et al.

It is certified that error appears in the above-identified patent and that said Letters Patent is hereby corrected as shown below:

Title page,
Item [73], Assignees, should read:
-- Item [73], Assignees: Volkswagen AG, Wolfsburg (DE) and Hydraulik-Ring GmbH, Nurtingen (DE). --.

Signed and Sealed this

Eleventh Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,675,752 B1
APPLICATION NO. : 10/088453
DATED : January 13, 2004
INVENTOR(S) : Kunne et al.

It is certified that error appears in the above-identified patent and that said Letters Patent is hereby corrected as shown below:

Title page,
Item [73], Assignees, should read:
-- Item [73], Assignees: Volkswagen AG, Wolfsburg (DE) and Hydraulik-Ring GmbH, Nurtingen (DE). --.

This certificate supersedes Certificate of Correction issued April 11, 2006.

Signed and Sealed this

Eighteenth Day of July, 2006

JON W. DUDAS
*Director of the United States Patent and Trademark Office*